US006029724A

United States Patent [19]

Rudnick

[11] Patent Number: 6,029,724

[45] Date of Patent: Feb. 29, 2000

[54] WALLET HAVING TABBED IDENTIFIED POCKETS

[76] Inventor: Jack Rudnick, 217 Robin Hill Rd., Paintsville, Ky. 41240

[21] Appl. No.: 09/027,799

[22] Filed: Feb. 23, 1998

[51] Int. Cl.[7] ..... A45C 1/06

[52] U.S. Cl. ..... 150/131; 150/145; 150/147

[58] Field of Search ..... 150/131, 132, 150/145, 147, 112, 113

[56] References Cited

U.S. PATENT DOCUMENTS

| | | | |
|---|---|---|---|
| 2,439,731 | 4/1948 | Hawes | 150/145 X |
| 3,392,771 | 7/1968 | Hartley | 150/147 X |
| 3,659,640 | 5/1972 | Fenster et al. | 150/147 |
| 4,004,690 | 1/1977 | Giarritta | 150/147 X |
| 4,670,853 | 6/1987 | Stepien | 150/147 X |
| 4,716,948 | 1/1988 | Brissette | 150/147 X |
| 4,895,198 | 1/1990 | Samuelsom | 150/113 X |
| 4,974,983 | 12/1990 | Givati | 150/147 X |
| 5,048,582 | 9/1991 | Whitfield | 150/112 |
| 5,431,207 | 7/1995 | Siegel | 150/147 X |
| 5,713,406 | 2/1998 | Drury | 150/147 X |
| 5,778,954 | 7/1998 | Sullivan et al. | 150/147 X |

*Primary Examiner*—Sue A. Weaver

[57] ABSTRACT

A foldable wallet includes a plurality of pockets bearing identifying indicia for holding credit cards and the like. A front panel is provided with spaces for presenting identifying descriptions of the items in one of the pockets and identifying indicia corresponding to the indicia on one of the pockets.

6 Claims, 1 Drawing Sheet

WALLET HAVING TABBED IDENTIFIED POCKETS

BACKGROUND OF THE INVENTION

The invention relates generally to wallets. More specifically it relates to improvements to wallets in which identification cards of various types are kept.

In recent years wallets, in addition to holding paper money, have been called upon to hold a variety of identification cards, such as credit cards, drivers licenses, insurance cards and the like. The number and varieties of such cards has increased considerably in recent years frequently compelling persons seeking, when called upon, to pull out a variety of cards before finding the right one.

Therefore, it is an object of the invention to provide a novel wallet provided with means to assist a user to, relatively easily, insert, extract and replace an identification card.

It is another object of this invention to provide a novel wallet with means to identify the specific location of a wanted identification card.

SUMMARY OF THE INVENTION

The invention comprises a wallet made of a desired material, having a portion provided with a plurality of locations for the placement of visible descriptions of identification cards and indicia of their respective locations in pockets formed in the wallet. The pockets are provided with corresponding indicia so that one may easily locate the desired pocket.

BRIEF DESCRIPTION OF THE DRAWINGS

The invention may be understood by reference to the following detailed description with reference to the drawings, in which.

DETAILED DESCRIPTION

Figure 2:
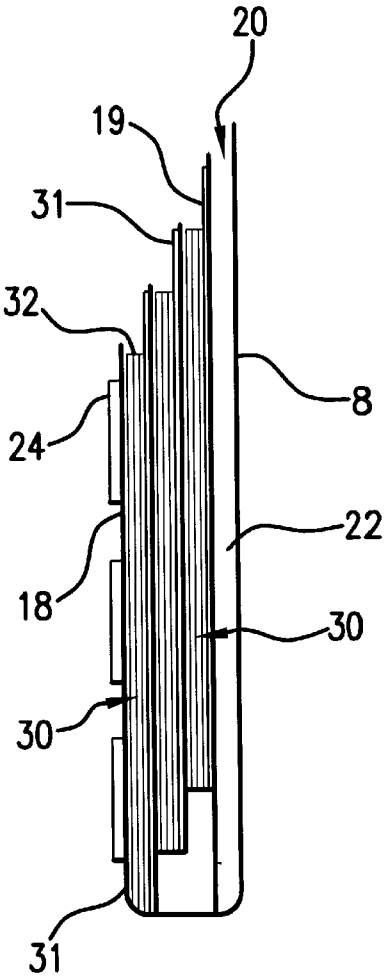
FIG. 2 is a cross section view along the line 2—2 of FIG. 1.
Figure 1:
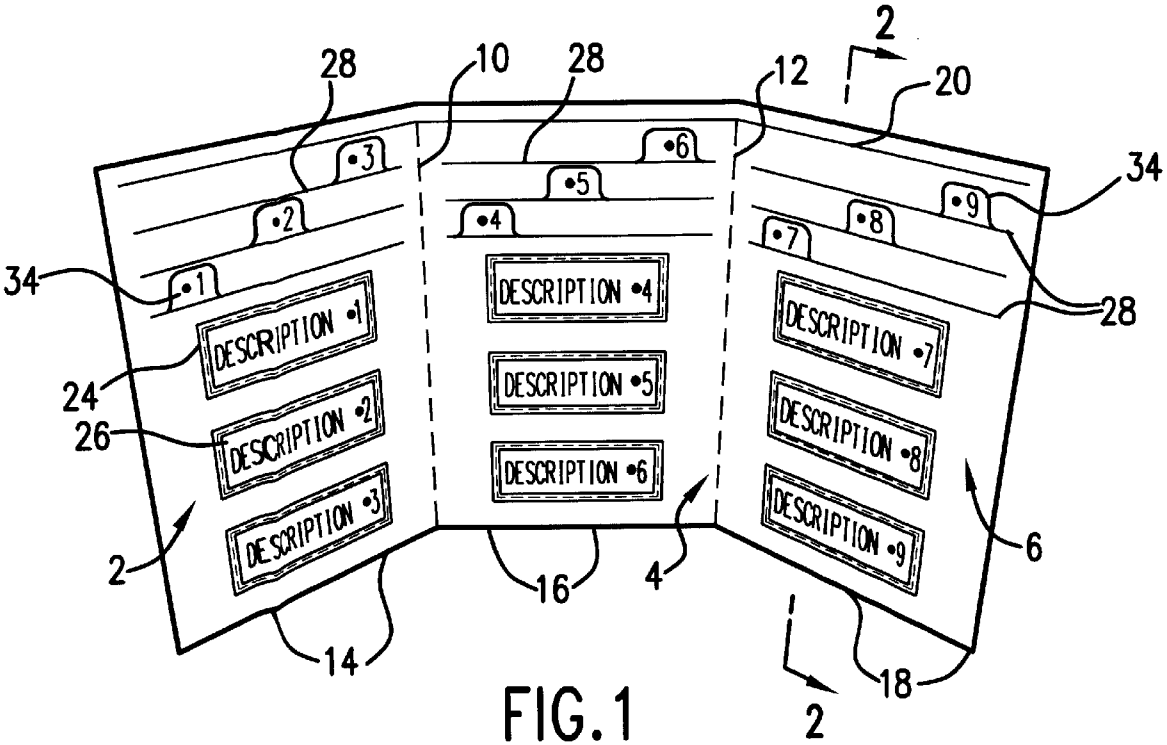
FIG. 1 is an isometric view of an embodiment of the invention.

FIG. 1 illustrates an embodiment of the invention. A wallet embodying the invention is formed with three sections, 2, 4 and 6. A back panel 8 (see FIG. 2) extends over the length of the wallet and has hinging lines 10 and 12 that permit the wallet to be opened and closed there along, so that three front sections, 14, 16 and 18 are formed. To close the wallet when not in use the panels 14 and 18 are folded along the hinging lines 10 and 12 so that one of those panels will overlie the other, providing a conventional size wallet for placement in a user's pocket or purse.

In this embodiment the three panels 14,16 and 18 are formed as a single front panel attached by a suitable means, such as by sewing a lining or separator 19 to the back panel 8. The separator 19 is not attached to the back panel 8 at its' upper end to form an opening 20 to a space 22 between the back and front panels into which paper money or other desired items may be placed.

Attached to each of the panels 14,16 and 18 are a plurality of identifying pockets 24. As illustrated in the FIG. 1, there are three such pockets on each panel. Each pocket has a transparent face or window 26 and is open across its' top. A description card, along with location identifying indicia, such as a number or alphabetic character may be inserted. As the cards carried by individuals may change over time these descriptions and location indicia may be changed as needed.

The front panel joined by the sections, 2, 4 and 6 is formed with a plurality of openings 28, providing access to one of the card holding pockets 30. Separators 31 at the bottom and between each pocket are stepped from each other so as to provide pockets 32 each stepped a different distance from the bottom of the wallet. Each opening 20 into a pocket 32 is provided with an identifying tab 34, corresponding to an identifying location indicia placed on an identifying card placed on a card inserted into one of the pockets 24.

In the use of this invention a credit or other type of identifying card may be placed in one of the card holding pockets 32. A description of the card is placed in one of the identifying pockets along with an indicator identifying the holding pocket into which the card has been inserted.

Obviously there are variations in the details of design, choice of materials and means for attaching the various parts of the invention which may be made by a designer in making embodiments of the invention.

What is claimed is:

1. A wallet having a plurality of foldable panels; a plurality of item-holding pockets on at least one of said panels, an identifying tab at the opening to each such pocket, identifying pockets on each panel having item-holding pockets corresponding in number to the number of item-holding pockets; and, each identifying pocket including means to display an indicator corresponding to an identifying tab on an item-holding pocket.

2. The wallet of claim 1 comprising three foldable panels.

3. The wallet of claim 2 wherein said identifying pockets have transparent windows through which an item description and an indicator may be seen.

4. The wallet of claim 3 including a replaceable card on which an item description in at least one of said identifying pockets.

5. The wallet of claim 1 wherein said identifying pockets have transparent windows through which an item description and an indicator may be seen.

6. The wallet of claim 5 including a replaceable card in at least one of said identifying pockets on which an item description may be placed.

* * * * *